United States Patent [19]

Touret

[11] 4,380,962

[45] Apr. 26, 1983

[54] NEEDLE POSITIONING DEVICE FOR SEWING MACHINES

[75] Inventor: Jean P. Touret, Chatillon sur Bagneux, France

[73] Assignee: Rockwell International Corporation, Pittsburgh, Pa.

[21] Appl. No.: 223,614

[22] Filed: Jan. 9, 1981

[30] Foreign Application Priority Data

Feb. 5, 1980 [IT] Italy ..... 19698 A/80

[51] Int. Cl.[3] ..... D05B 69/22

[52] U.S. Cl. ..... 112/274

[58] Field of Search ..... 112/274, 275, 276

[56] References Cited

U.S. PATENT DOCUMENTS

| | | | |
|---|---|---|---|
| 3,592,153 | 7/1971 | Mangeneson | 112/276 |
| 3,763,803 | 10/1973 | Matsuda | 112/275 |
| 3,977,339 | 8/1976 | Tice | 112/274 X |
| 4,073,250 | 2/1978 | Kasuga | 112/274 |
| 4,079,686 | 3/1978 | Kasuga | 112/274 |
| 4,083,316 | 4/1978 | Kasuga | 112/274 |
| 4,270,474 | 6/1981 | Tice | 112/276 |
| 4,271,775 | 6/1981 | Tice | 112/276 |

*Primary Examiner*—Werner H. Schroeder
*Assistant Examiner*—Andrew M. Falik

[57] ABSTRACT

A device for locating the needle of a sewing machine in a preselected position upon completion of a sewing operation. The device includes a control shaft operatively connected to the needle and by driving elements, to a clutch brake type operating motor. A cylindrical member having a reference pin extending radially from its periphery is fixed on the control shaft and is operatively connected to an auxiliary actuator which when the machine is stopped is caused by a control apparatus to rotate the cylindrical member and its reference pin. The control apparatus is also effective in moving a stud into the pathway of the reference pin and when the two engage one another, the cylindrical member and control shaft are stopped which positions the needle in a preselected position.

7 Claims, 6 Drawing Figures

NEEDLE POSITIONING DEVICE FOR SEWING MACHINES

BACKGROUND OF THE INVENTION

The present invention pertains to a sewing machine having a control shaft for operating the machine's needle and with said control shaft being connected, via transmission means, to an operating motor of the clutch and brake type that includes means for selectively effecting rotation or the braking of said control shaft. The sewing machine is further provided with a needle positioning device comprising means for effecting selective positioning of the needle which is operatively connected to the control shaft and an auxiliary actuator is adapted to cause the necessary movement of said control shaft as is necessary for positioning the needle. A unidirectional auxiliary transmission or clutching means is located between the auxiliary actuator and the selective positioning means and is adapted to transmit the rotational movement of the auxiliary actuator to the control shaft and by locating elements operatively associated with said selective positioning means the needle can be stopped in a preselected position.

Sewing machines of the type described above are well known in the sewing art; however, the associated needle positioning device which is utilized with them is considered to increase the overall cost of such machines by an excessive amount.

The majority of research efforts in this field have been mainly directed towards attempts to simplify these positioning devices in order to reduce their cost and thereby lessen the overall cost of the sewing machine. The most common result of this work has been the separation from the operating motor of the auxiliary actuator which is necessary for moving the control shaft during the operation of positioning the needle to a desired and predetermined position.

In practice, however, provision of separate and independent auxiliary actuating means has not provided completely satisfactory results for use has been made of actuating means which are considered to be bulky and cumbersome such as for example pneumatic units provided with a control rack and an associated pinion on the transmission apparatus for the positioning device.

An object of the present invention is to provide a sewing machine, having a conventional and well known type of clutch brake motor with a needle positioning device of simplified construction, relatively inexpensive to manufacture, reliable in operation and which can be assembled on new and existing sewing machines without modifications thereto.

SUMMARY OF THE INVENTION

The needle positioning device for sewing machines of the present invention includes a cylindrical member having an axial bore defining a seat which by means of a locking screw is adapted to be mounted on the end of the control shaft which projects outwardly from the machine. This cylindrical member includes a radially extending reference pin and in alignment with the axial bore a shaft element extending axially from the cylindrical member which is adapted to support a unidirectional clutching device that is operatively connected to a pulley of an auxiliary actuator. The auxiliary actuator includes a pneumatic cylinder the piston of which is operatively connected to any suitable source of compressed air and to the pulley by means of a flexible cable with the opposite end of the latter being connected to a return means that defines a coil spring. This pneumatic cylinder is mounted on and depends from a support plate which is fixedly positioned relative to the location of the sewing machine and also carries locating elements disposed so as to cooperate with the reference pin and effect stopping the needle in a preselected position.

Further objects and advantages of the invention will become more fully apparent by reference to the appended claims and as the following detailed description proceeds in reference to the figures of drawings wherein:

DESCRIPTION OF THE PREFERRED EMBODIMENT

Figure 1:
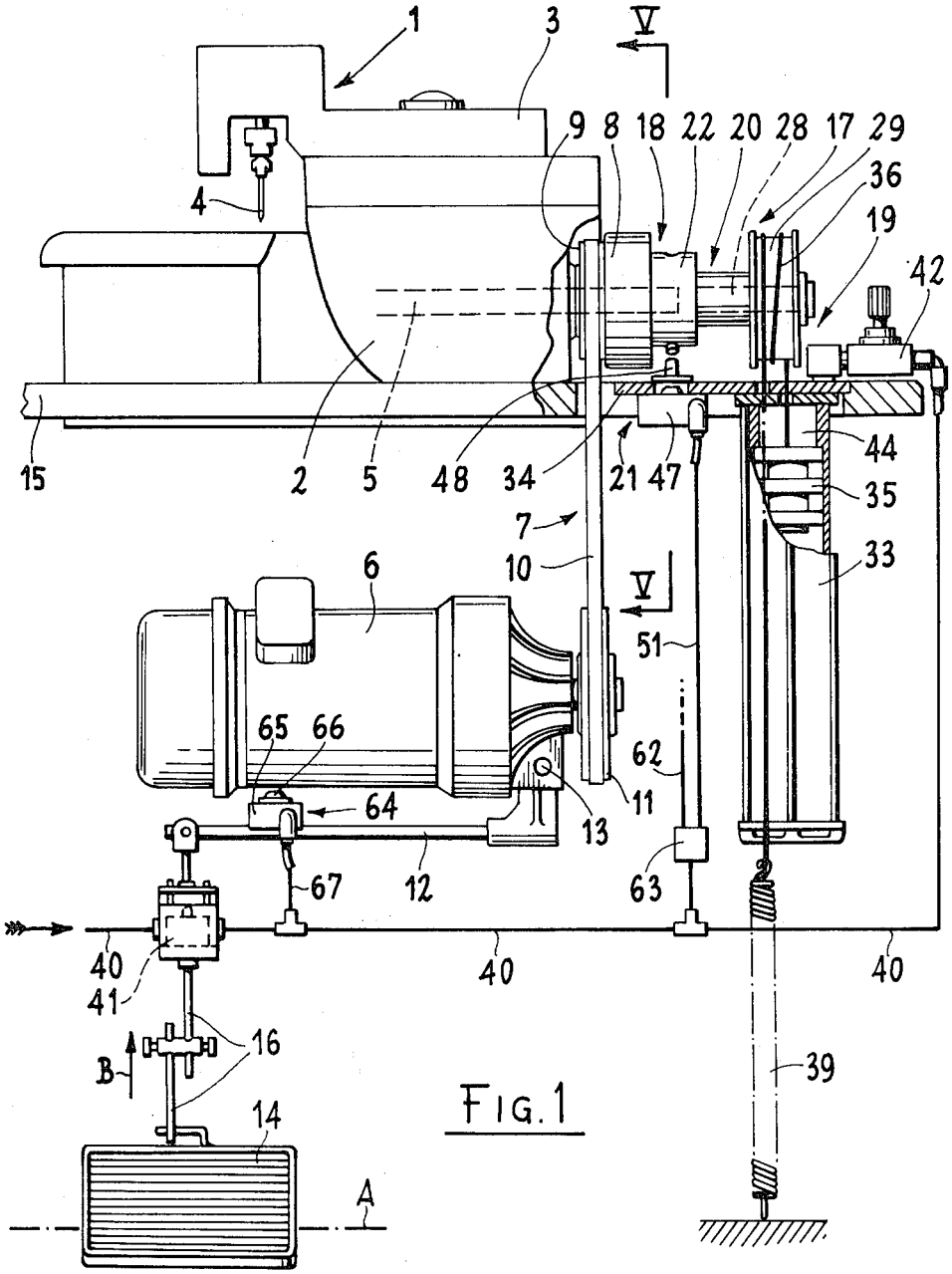
FIG. 1 is a view in front elevation and partially in section of a sewing machine with the device according to the invention applied thereto.

In the embodiment shown in FIG. 1 only those parts of a sewing machine have been shown which are required for a complete understanding of the invention. In FIG. 1 the frame of the sewing machine is depicted generally by numeral 1 and includes a base 2 that supports an upright 3. The machine's needle is identified by numeral 4 and depends in a conventional manner from one end of the upright 3 as shown in FIG. 1. By well known driving elements (not shown) contained within the upright 3, the needle 4 is operatively connected to the machine's control shaft 5 which is supported for rotation within the base 2. Rotation of the control shaft 5 is effected by the machine's operating motor 6 through a transmission means identified generally by numeral 7. This transmission means includes a flywheel 8 having a pulley 9 forming one side thereof which are assembled on that portion of the control shaft 5 which projects outwardly from the base 2. A drive belt 10 interconnects the pulley 9 with a drive pulley 11 located on the driving shaft of the machine's operating motor 6.

The motor 6 is of the clutch and brake type having a movable clutch located on the same shaft as the drive pulley 11 and a brake operatively associated with the housing of the motor such as shown and described in U.S. Pat. No. 3,114,340. The motor also includes an operating lever 12, which is pivotably mounted as at 13 on the motor housing and serves to selectively start and stop the control shaft 5 by displacing the clutch from the brake so that it engages the rotor of the motor and alternatively braking of the control shaft by shifting the clutch to its initial position where it engages the brake. The machine is started by lowering the operating lever 12 by means of a conventional pedal 14 which is pivotably mounted on the sewing machine bench. The only portion of the bench shown is the upper supporting surface 15 and the axis "A" about which the pedal 14 is caused to pivot.

A linkage member 16 interconnects the pedal 14 and the lever 12 and is of the adjustable length type commonly utilized with sewing machines. Being of a well known type, the linkage member 16 cannot be lengthened when it is pulled downwardly by the pedal and its specific function within the framework of the present invention will be described in further detail hereinafter.

In sewing machines to which the present invention is applicable, the stopping of the needle at a location corresponding to one of its dead points is accomplished by a positioning device that is generally indicated in FIG. 1 by numeral 17. The needle positioning device is provided with a selective positioning means 18 which is assembled on the control shaft 5 and serves to continuously indicate at which position the needle is located during the performance of its intended function. The positioning device also includes an auxiliary actuator 19 which effects rotation of the control shaft 5 from the angular position at which it comes to rest when the machine is stopped at the completion of sewing so as to reach the preselected angular position at which it must be located in order to move the needle to its desired position. A unidirectional clutching device 20 is assembled intermediate the auxiliary actuator 19 and the positioning means 18 and serves to transmit to said positioning means the rotational motion generated by said auxiliary actuator. A locating means 21 is operatively associated with the selective positioning means so that when the latter receives the rotational motion from the auxiliary actuator, said locating means effectively stops the needle in a preselected position.

Figure 2:
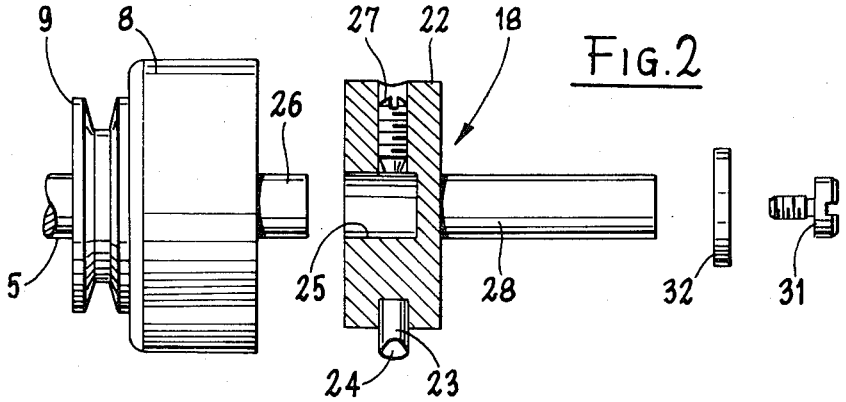
FIG. 2 is a view in side elevation and partially in section showing the means by which the invention is connected to a sewing machine.

Referring now to FIG. 2, the selective positioning means 18 will now be described and it includes a cylindrical member 22 provided with radial reference means which defines a reference pin 23 that is disposed so as to project radially from the periphery thereof. The reference pin 23 is provided with an inclined outer end 24 which is inclined in the same direction as that in which it is caused to move during rotation of the control shaft 5.

As shown in FIG. 2 the cylindrical member 22 is further provided with a central bore that defines an axial seat 25 which serves as a means for mounting said cylindrical member on the end portion 26 of the control shaft which projects outwardly from the flywheel 8. This end portion 26 normally serves as a support for the conventional flywheel housing (not shown) on sewing machines not provided with a needle positioning device.

Referring once again to FIG. 2, a locking screw 27 assembled in a radially extending tapped hole in the cylindrical member 22 provides the necessary means for fixing the desirable position of said cylindrical member on the end portion 26 which is an extension of the control shaft 5. The cylindrical member 22 also includes a centrally disposed shaft 28 which forms an axial extension of the cylindrical seat 25.

Figure 3:
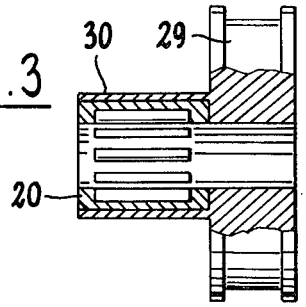
FIG. 3 is a side view partially in section of the unidirectional clutching member for the positioning device.

The shaft 28 serves as a support for the unidirectional clutching device 20 (FIG. 3) which being of the roller type, is well known to those conversant in the art. Additionally shaft 28 provides a support for a grooved pulley 29 of the auxiliary actuator 19. This grooved pulley 29 has a hub 30 which defines a housing for the clutching device 20. The shaft 28 is further provided with a tapped hole (not shown) in its end which is adapted to receive a locking screw 31 with a washer 32 and serves to maintain the grooved pulley 29 in its operating position on the shaft 28. The combination of the grooved pulley 29 and clutching device 20 on shaft 28 permits said pulley to rotate freely in one direction after stopping the machine, and will not permit rotation thereof during machine operation.

Figure 4:
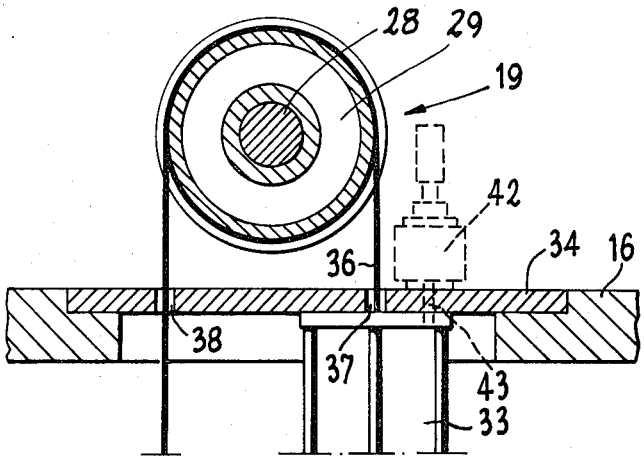
FIG. 4 is a sectional view of the auxiliary actuator as seen from the right in FIG. 1.

The auxiliary actuator 19 includes a pneumatic cylinder 33 (FIGS. 1 and 4) that is fixed on and depends from the underside of a support plate 34 which is fixedly attached by any suitable means (not shown) to the upper supporting surface 15 adjacent to and on which the sewing machine is also fixed. The pneumatic cylinder 33 is disposed so as to be in alignment with the grooved pulley 29 whereby the axis of the piston 35 is tangential to the surface of said pulley.

The piston 35 is operatively connected to the grooved pulley 29 by means of a cable 36, one end of which is attached to said piston. This cable is arranged to pass through an opening 37 (FIG. 4) formed in the support plate 34 and is wrapped one or more times around the groove of the pulley 29 in order to provide a sufficient driving force thereto. From the groove of the pulley, the cable extends through an opening 38 formed in the support plate that is spaced from opening 37. The end of the cable opposite its attachment to the piston 35 is attached to the upper end of a return spring 39 whose lower end is connected to the bench of the sewing machine. This return spring 39 serves as a means for maintaining the cable 36 in positive contact with the grooved surface of the pulley during the needle positioning function and for causing the piston to return to its initial position after the auxiliary actuator 19 has been deactivated. The function of the return spring could also be accomplished by such means as a simple counterweight. The pneumatic cylinder 33 is connected to any suitable source of compressed air (not shown) by means of a conduit 40 and the air delivered to said cylinder is manually controlled by means of a valve 41 operatively connected to said conduit and with the linkage member 16 which is actuated by the pedal 14. This means of manual control is effective in activating the needle positioning device 17 after the sewing machine has been stopped. When the pedal is returned to its rest position by exerting pressure on the rear side thereof, the linkage member 16 is caused to move in the direction of the indicating arrow B in FIG. 1 by a limited amount which will open valve 41 without effecting movement of the operating lever 12. This is accomplished by means of the linkage member 16 being capable of sliding telescopically within the support element provided for the valve 41 by an amount which will activate only said valve. Opening of valve 41 causes compressed air to engage the piston 35 by passing through the conduit 40, a flow regulator 42 mounted on the support plate 34 and thence a passage 43 (FIG. 4) formed in the latter which communicates with the expansion chamber 44 of the cylinder.

The support plate 34 is provided with an opening 45 (FIG. 5) at a position corresponding to the position indicating device 18 which serves to house a piston 46 of an associated pneumatic cylinder 47 for the locating means 21. This locating means includes at least one stud 48 (FIGS. 1 and 5) mounted on an elastic lamina 49 which is attached to the upper surface of the support plate by means of screws 50 in a manner which positions said stud directly above the piston 46.

The pneumatic cylinder 47 is operatively connected to the conduit 40 of the auxiliary actuator 19 by means of a conduit 51 and upon actuation of the valve 41 said auxiliary actuator 19 and cylinder 47 are activated simultaneously. The upper or free end of the stud 48 is provided with an inclined surface 52 which extends so as to provide a surface configuration which conforms to the inclined surface 24 of the reference pin 23. The two inclined surfaces 24 and 52 are adapted to move or engage one another upon completion of the needle positioning operation so as to prevent the selective positioning means for rotating beyond a preselected position.

Upon activation of the auxiliary actuator 19, the simultaneous flow of compressed air to the pneumatic cylinder 47 causes its piston 46 to move upwardly to effect upward flexing of the elastic lamina 49, which raises the stud 48 into the circular path through which the reference pin 23 is travelling until it reaches a position where it will be engaged by said reference pin 23.

Figure 5:
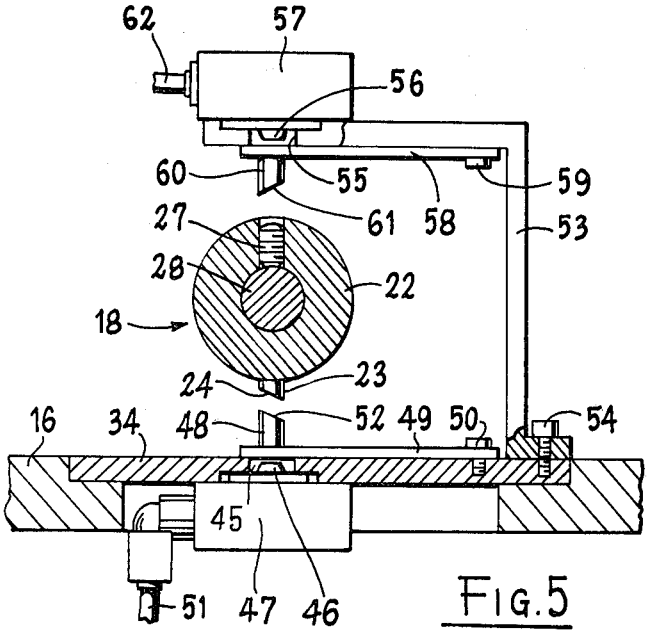
FIG. 5 is a sectional view of the needle positioning device as seen looking in the direction of the indicating arrows of line V—V in FIG. 1.

Referring now to FIG. 5, a right-angled support bracket 53 is attached to the support plate 34 by means of screws 54 and extending from said support plate its terminus portion is disposed in spaced and opposed relation to the stud 48 and the elastic lamina 49. This support bracket 53 is provided adjacent its free end with an opening 55 which serves as a housing for a piston 56 of a pneumatic cylinder 57. A second elastic lamina 58 which is identical to the one identified by numeral 49 is attached by means of screws 59 to the support bracket 53 and as shown in FIG. 5 is disposed below and in operative association with the piston 56. This lamina 58 also has a stud attached thereto which is depicted by numeral 60 and like stud 48 the free end thereof is provided with an inclined surface 61 that also conforms to the inclined surface 24 of the reference pin 23.

The pneumatic cylinder 57 is operatively connected to the valve 41 by means of a conduit 62 which terminates in a pneumatic changeover valve 63 (FIG. 1) to which the conduit 51 referred to above is also connected. The pneumatic changeover valve serves as a means for selecting at which one of the two extreme positions the needle is to stop. Selection of this position is obtained by operating the pneumatic changeover valve so as to put conduit 40 in communication with conduit 51 or alternatively with conduit 62. Actuation of one of the two pneumatic cylinders 47 or 57 displaces either stud 48 or stud 60 into the path of the reference pin 23 causing its travel to cease without danger of any damage since the auxiliary actuator is operated by compressed air which, as is known, is low power energy.

To disconnect the sewing machine from the motor 6, which at the time of needle positioning has its clutch locked against the brake, a release means 64 (FIG. 1) is provided between the operating lever 12 and the motor 6. This release means includes a pneumatic cylinder 65 which is fixed to the operating lever 12 and with the piston 66 thereof being directed towards the housing of motor 6. The pneumatic cylinder 65 is connected to the supply conduit 40 by means of a conduit 67, and when the auxiliary actuator is put into operation by opening valve 41, the release means effects release of the motor clutch from the brake by a limited amount which is sufficient to free the transmission means 7 thereby freeing the control shaft so that it can be rotated by the auxiliary actuator. This release is accomplished by means of the piston 66 pushing against the housing of the motor 6 so as to cause the operating lever 12 to be pivoted downwardly a predetermined distance.

Figure 6:
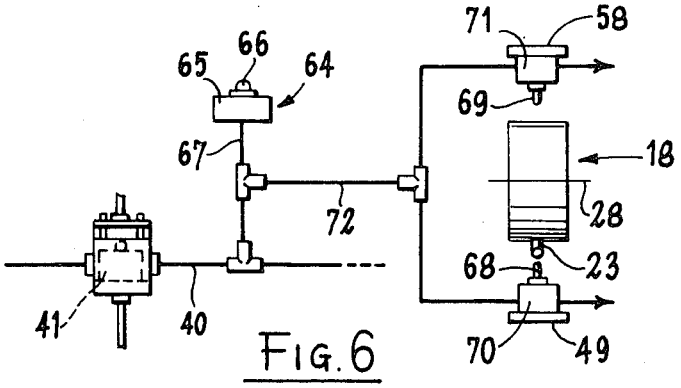
FIG. 6 is a diagrammatic view of the control circuit for the needle positioning device.

In FIG. 6 a modification of the needle positioning means is shown and provides a means whereby one or both of the studs 48 and 60 can be caused to be moved into the pathway of the reference pin 23. As shown in this figure of drawing, these studs are defined by the piston rods 68 and 69 of pneumatic cylinders 70 and 71 that are mounted on the elastic lamina 49 and 58 respectively. Each of these cylinders communicates separately with the atmosphere and by means of a common conduit 72, they are both connected to the conduit 67 which supplies the release means 64.

Upon actuation of the valve 41, both the release means 64 and one of the pneumatic cylinders 47 or 57 selected by means of the changeover valve 63 are actuated and effects release of the transmission means 7 from the brake and movement of either stud 48 or 60 into the path of the reference pin 23. When the reference pin 23 comes into contact with one or the other of the studs moved into its pathway, the corresponding pneumatic cylinder (47 or 57) discharges the compressed air contained within the conduits and in particular the air within conduit 67, thus immediately restoring instantaneous braking of the sewing machine and deactivating the needle positioning device.

Although the present invention has been described in connection with a preferred embodiment and a single modification thereto it is to be understood that modifications and variations may be resorted to without departing from the spirit and scope of the invention as those skilled in the art will readily understand. Such modifications and variations are considered to be within the purview and scope of the invention and the appended claims.

I claim:

1. A needle positioning device for sewing machines of the type having a clutch brake type operating motor, a control shaft operatively connected to the needle and to the motor by transmission drive members with an operatively associated control apparatus for selectively operating and braking the control shaft through said operating motor, said needle positioning device comprising:

(a) a selective positioning means (18) including:
  (i) a cylindrical member (22) mounted on and for rotation with the control shaft;
  (ii) a reference pin (23) fixed in and extending radially from the periphery of said cylindrical member;
(b) an auxiliary actuator (19) operatively associated with the control shaft for effecting selective rotation thereof upon stopping the sewing machine including:
  (i) a pulley (29) operatively connected to the control shaft;
  (ii) a pneumatic cylinder (33) connected to the control apparatus;
  (iii) flexible means defining a cable (36) interconnecting the piston of said pneumatic cylinder (33) with said pulley 29;
  (iv) return means defining a spring (39) connected to said cable (36) for returning the piston and said pulley (29) to their initial positions upon completion of selective location of the needle;
(c) release means (64) operatively connected to the control apparatus and said operating motor for temporarily disconnecting the control shaft from the motor during selective rotation of the control shaft by said auxiliary actuator;
(d) a unidirectional clutching device (20) mounted on the control shaft intermediate said cylindrical member (22) and auxiliary actuator (19) for transmitting the motion provided to the control shaft and said cylindrical member; and (e) locating means for moving a stud into the pathway of travel of said reference pin (23) to effect stopping the needle in a preselected position.

2. The needle positioning device according to claim 1 wherein said locating means includes:

(a) an elastic lamina (49) spaced from and operatively associated with said cylindrical member (22);

(b) a stud (48) mounted on said elastic lamina in spaced and aligned relation with the pathway of said reference pin (23);

(c) a pneumatic cylinder (47) including:

(i) a piston (46) operatively connected to said elastic lamina (49) for flexing the latter and moving said stud (48) into the pathway of said reference pin (23) to effect stopping the needle in a preselected position.

3. The needle positioning device according to claim 2 wherein said locating means further includes:

(a) a second elastic lamina (58) spaced from and operatively associated with said cylindrical member (22) in a position diametrically opposite said lamina (49);

(b) a stud (60) mounted on said elastic lamina (58) in spaced and aligned relation with the pathway of said reference pin (23);

(c) a pneumatic cylinder (57) including:

(i) a piston (60) operatively connected to said elastic lamina (58) for flexing the latter and moving said stud (60) into the pathway of said reference pin 23 to effect stopping the needle in a preselected position different from that provided by said stud (48).

4. The needle positioning device according to claim 1 wherein said locating means includes:

(a) an elastic lamina (49) spaced from and operatively associated with said cylindrical member (22);

(b) a pneumatic cylinder (70) mounted on said lamina (49) including:

(i) a piston rod (68) spaced from and aligned with said reference pin (23) and movable by said pneumatic cylinder (70) into the pathway of said reference pin (23) to effect stopping the needle in a preselected position.

5. The needle positioning device according to claim 4 wherein said locating means includes:

(a) a second elastic lamina (58) spaced from and operatively associated with said cylindrical member (22) in a position diametrically opposite said lamina (49);

(b) a pneumatic cylinder (71) mounted on said lamina (58) including:

(i) a piston rod (69) spaced from and aligned with said reference pin (23) and movable by said pneumatic cylinder (71) into the pathway of said reference pin (23) to effect stopping the needle in a preselected position different from that provided by said piston rod (68).

6. The needle positioning device according to claim 3 wherein said locating means includes a changeover valve (63) for effecting independent actuation of said pneumatic cylinders (47, 57, 70, 71).

7. The needle positioning device according to claim 1 wherein said release means includes:

(a) a pneumatic cylinder (65) operatively connected to the control apparatus; and (b) a piston (66) controlled by said pneumatic cylinder (65) operatively connected to the operating motor for pivoting the latter's operating lever (12) a sufficient distance to permit limited rotation of the control shaft by said auxiliary actuator (19).

* * * * *